US006368122B2

(12) United States Patent
Billman

(10) Patent No.: US 6,368,122 B2
(45) Date of Patent: Apr. 9, 2002

(54) BRACKET HAVING A RECOVERABLE DOOR

(75) Inventor: Timothy Brian Billman, Dover, PA (US)

(73) Assignee: Hon Hai Precisiopn Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/745,118

(22) Filed: Dec. 20, 2000

Related U.S. Application Data

(63) Continuation-in-part of application No. 09/576,739, filed on May 23, 2000.

(51) Int. Cl.[7] ..... H01R 13/453
(52) U.S. Cl. ..... 439/138
(58) Field of Search ..... 439/136–138, 439/607–610

(56) References Cited

U.S. PATENT DOCUMENTS 5,879,173 A * 3/1999 Poplawski et al. ..... 439/138
6,095,862 A * 8/2000 Doye et al. ..... 439/138

* cited by examiner

*Primary Examiner*—Gary Paumen
(74) *Attorney, Agent, or Firm*—Wei Te Chung

(57) ABSTRACT

A bracket for receiving an external electrical device is provided in this invention. The bracket comprises a frame, a door rotatably positioned on the frame, and a metal shielding fixed on the frame. The door comprises a shaft traversing therethrough. The shaft has a driving portion formed thereon. The metal shielding comprises a spring portion registered with the driving portion of the door. The driving portion of the door deforms the spring portion of the metal shielding when the door is rotated due to insertion of the external electric device into the bracket.

1 Claim, 5 Drawing Sheets

BRACKET HAVING A RECOVERABLE DOOR

CROSS REFERENCE APPLICATION

This is a continuation in part application of a U.S.A. application No. Ser. 09/576,739 filed on May. 23, 2000 which is pending now.

BACKGROUND OF THE INVENTION

1. Field of the Invention

The present invention relates to a bracket for receiving an external device such as a transceiver module or the like and, more particularly, to a bracket having a recoverable door which will be opened from an original closed position when the external device is inserted into the bracket, and which will recover to the original closed position when the external device is withdrawn from the bracket.

2. The Prior Art

Laser diodes are basic components used in an optical transceiver for converting electrical signals into decoded photo signals. Normally, the photo signal emitted from the laser diode is harmful to human eyes. U.S. Pat. No. 5, 879,173, disclosed a door hinged to a mounting panel by means of a shaft thereof and a coil spring is mounted on each shaft end of the door for automatically returning the door to its closed position after the door is opened. Normally, the assembling of the coil spring to the door is cumbersome. Moreover, the coil spring is apt to be detached from the shaft end and cause malfunction after several times of operation. It is requisite to provide a new structure, which can solve the problem as encountered in the conventional bracket using coil springs. The inventor of the present invention has filed a patent application Ser. No. 09/576,739 which provides a new bracket having self-resilient parts for returning the door back to its closed position without the use of coil springs. However, the self-resilient parts are difficult to manufacture therefore a simplifier structure having the same function is required.

SUMMARY OF THE INVENTION

The primary purpose of the present invention is to provide a new bracket which utilizes a self-resilient structure to return a door thereof from an opened position to an original closed position after an inserted electrical device is pulled off from the bracket.

According to one aspect of the present invention there is provided a bracket for receiving an external electrical device. The bracket comprises a frame, a door rotatably positioned on the frame, and a metal shielding fixed on the frame. The door comprises a shaft traversing therethrough. The shaft has a driving portion formed thereon. The metal shielding comprises a spring portion registered with the driving portion of the door. The driving portion of the door deforms the spring portion of the metal shielding when the door is rotated due to insertion of the external electric device into the bracket.

DETAILED DESCRIPTION OF THE PREFERRED EMBODIMENT

Figure 1:
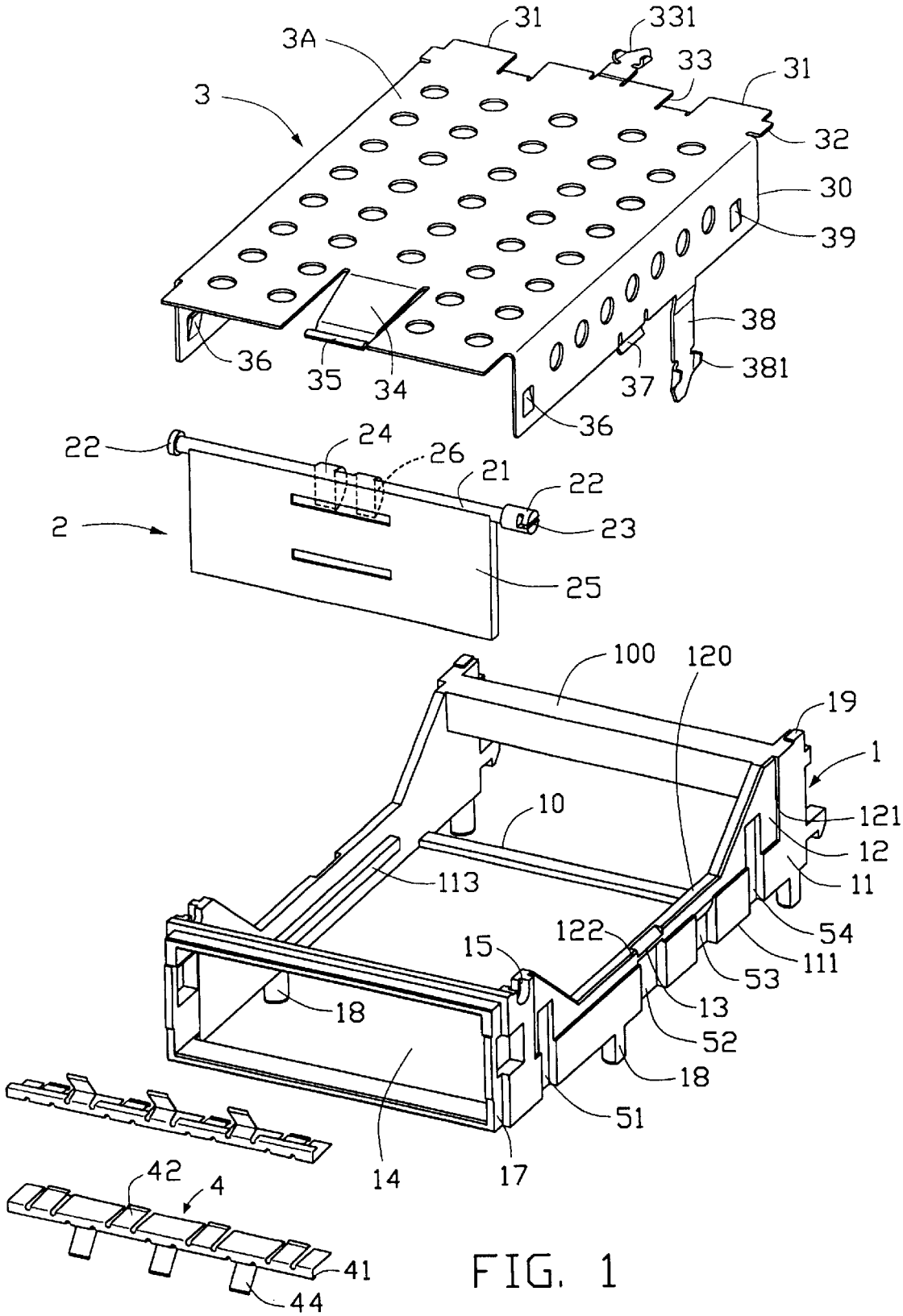
FIG. 1 is an exploded view of a bracket in accordance with the present invention having a frame, a metal door, a metal shielding and a ground plate.

Referring to FIG. 1, a bracket in accordance with the present invention comprises a frame 1, a metal door 2 ready to be received in the frame 1, a metal shielding 3 ready to be engaged with the frame 1. The frame may be made of metal or dielectric material. In this embodiment, the frame 1 is preferably made of metal via a die casting procedure.

The frame 1 has a rectangular closure 17 and two side walls 11 extending in parallel from opposite sides of the rectangular closure 17. An entrance 14 is defined in the rectangular closure 17 for passing an external transceiver module into the frame 1. A lower beam 10 and an upper beam 100 are connected between the side walls 11 for maintaining parallel relation between the side walls 11. Each side wall 11 has an upper surface 120 and a lower surface 111 and a guiding rail 113 formed on an inner surface thereof for guiding and positioning an external transceiver module (not shown) in the frame 1. A substantially U-shaped positioning groove 12 is defined in each side wall 11 and located between two side flanges 121 and a bottom flange 122. A slope face 13 is formed on an edge portion of the upper surface 120 of the side wall 11. A first recess 51, a second recess 52, a third recess 53, and a fourth recess 54 are defined in the side wall 11, wherein the second recess 52 is under the slope face 13. Two posts 18 extend downward from the lower surface 111 of each side wall 11 for positioning the frame 1 on a printed circuit board (not shown). A pair of positioning recesses 15, shaped like semicircle, actually cutouts in this embodiment, are defined in the side walls 11 and opposite to each other. A protrusion 19 projects from one end of each upper surface 120 of the side wall 11.

The metal door 2 has a plate portion 25 and a shaft 21 formed at the top thereof and extending beyond opposite sides of the plate portion 25 for a small distance. The shaft 21 terminates at each distal end a stop 22 and comprises a protrusive portion 24 extending laterally from a middle position thereof. An indication mark or groove 23 is formed on the stop 22 for showing whether the door 2 is opened or not when the door 2 is configured to the frame 1. In this embodiment, the protrusive portion 24 are two spaced-away cambered tabs 26 which are shown in phantom lines because they are blocked by the plate portion 25 in this view. However, the number of the cambered tabs is not limited to two; one or more than two still works. The length of the shaft 21 is so predetermined that when the shaft 21 is positioned on the positioning recesses 15, the stops 22 thereof just extend beyond the side walls 11 allowing the shaft 21 to rotate with respect to the side walls 11 while retain in contact with peripheries of the positioning recesses 15.

The metal shielding 3 comprises an upper plate 3A and two side plates 30 extending downward from two sides of the upper plate 3A. Each side plate 30 has a first tab 36, a second tab 37, a third tab 38, and a fourth tab 39 respectively corresponding, in physical location, to the first recess 51, the second recess 52, the third recess 53, and the fourth recess 54 of the side wall 11 of the frame 1. The first and the fourth tabs 36, 39 extend upward, while the second and the third tabs 37, 38 extend downward. The third tab 38 has a pair of barbs 381 formed at a lower portion thereof functioning as a board lock for engaging with a printed circuit board (not shown).

The upper plate 3A has a pair of first flanges 31 extending from two ends of a rear edge thereof. A second flange 32 extends laterally from the first flange 31. A third flange 33 extends rearward from the upper plate 3A and has a board lock 331 extending rearward. The third flange 33 is located between the first flanges 31. A spring arm 34 formed at a front edge of the upper plate 3A is shaped downward along a lengthwise direction thereof yet terminated as a curved end 35 extending upward.

A pair of ground plates 4 each has a curved side wall 41, and a plurality of resilient latches 42 and grounding tabs 44 alternately extend from the curved side wall 41. Specifically, the resilient latch 42 and the grounding tab 44 extend in different directions.

Figure 2:
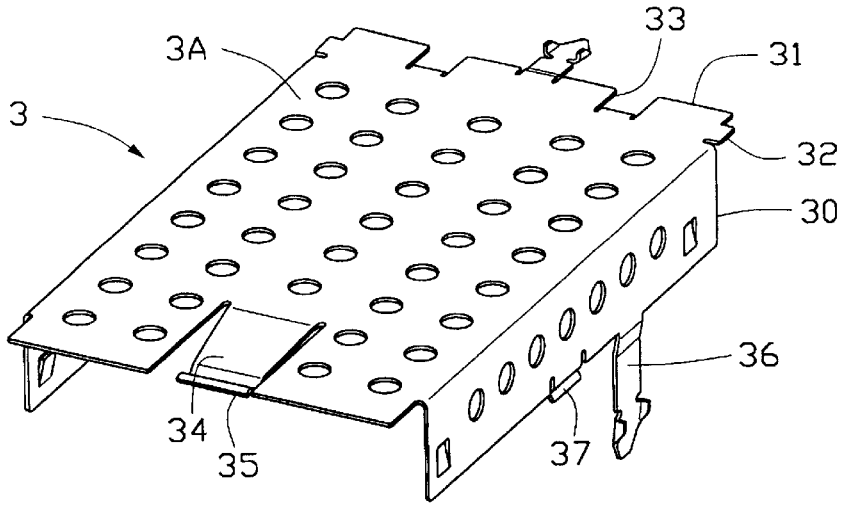
FIG. 2 is a view similar to FIG. 1, except that the metal door has been configured to the frame.
Figure 2:
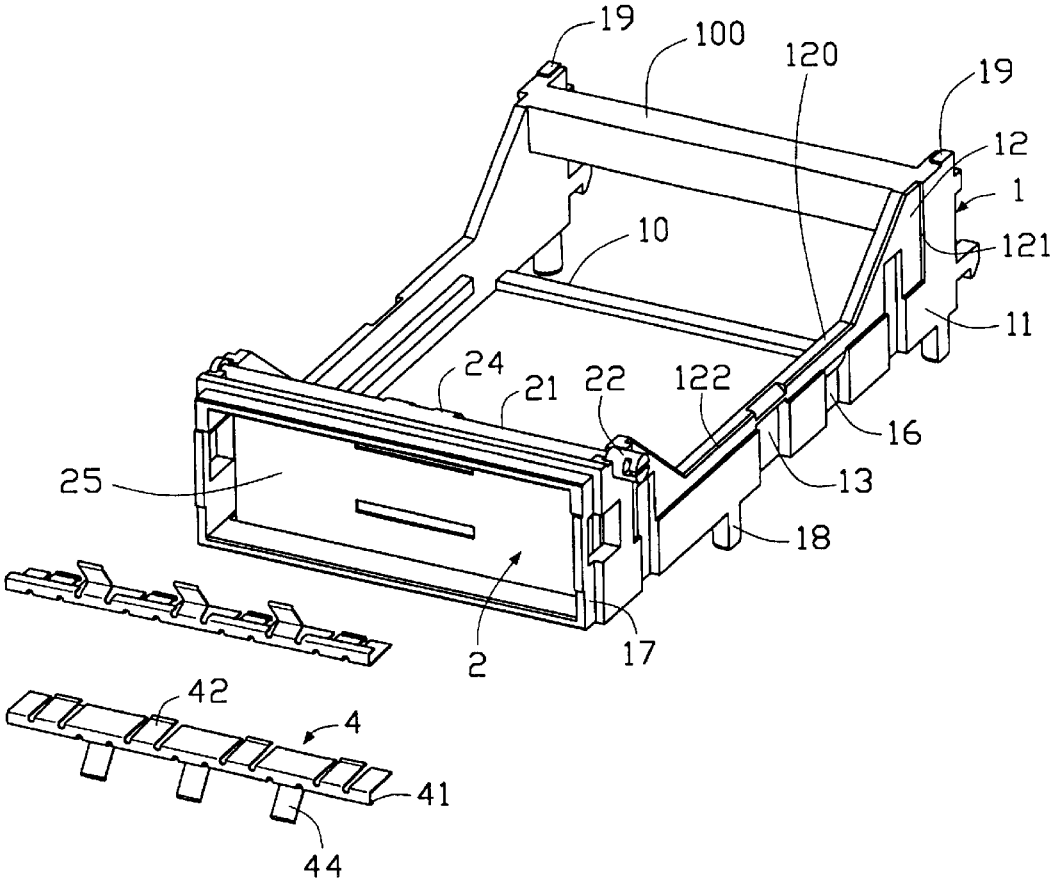

In assembling, as referring to FIG. 2, the metal door 2 is firstly configured to the frame 1 by locating the shaft 21 in the positioning recesses 15, with the stops 22 thereof respectively extending beyond the side walls 11 while the plate portion 25 of the metal door 2 is positioned between the side walls 11 and blocks the entrance 14 of the closure 17. With this configuration, the metal door 2 can be constantly rotated with respect to the frame 1 without lateral movement due to limitation of the two stops 22.

Figure 3:
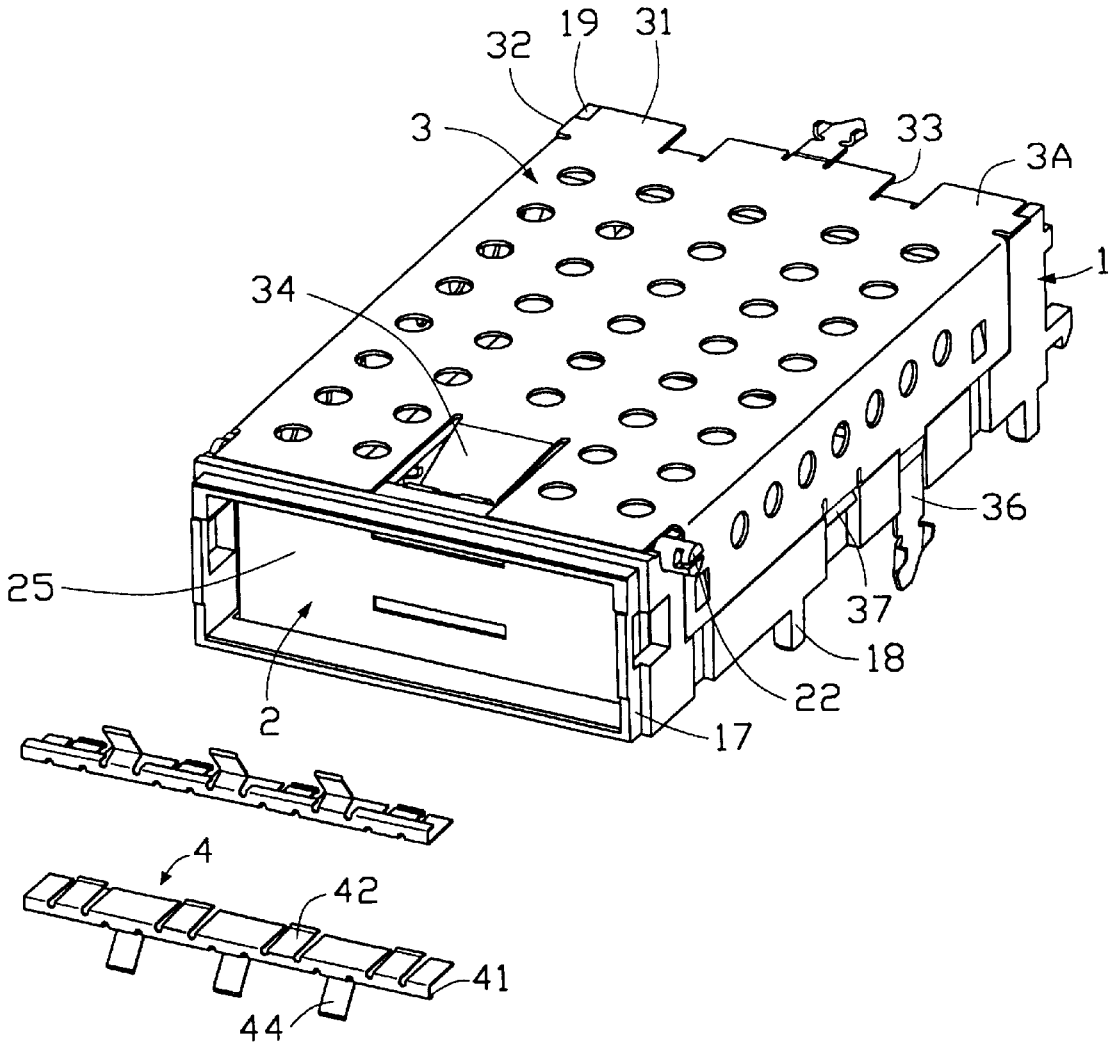
FIG. 3 is a view similar to FIG. 2, except that the metal shielding has been configured to the frame.

Also referring to FIG. 3, the metal shielding 3 is configured to the frame 1 by positioning the upper plate 3A on the closure 17 and the upper beam 100, and positioning the side plates 30 in the U-shaped positioning groove 12, wherein edges of each side plate 30 is in contact with the side flanges 121 and the bottom flange 122. The first flange 31 and the second flange 32 of the upper plate 3A is in contact with the protrusion 19. When the metal shielding 3 is configured to the frame 1, the second tab 37 slides over the slope face 13 and is received in the second recess 52, meanwhile the first tab 36, the third tab 38, and the fourth tab 39 are respectively received in the first recess 51, the third recess 53, and the fourth recess 54 for fixing the metal shielding 3 to the frame 1. The curved end 35 of the spring arm 34 is registered with the protrusive portion 24 of the metal door 2. For example, the curved end 35 of the spring arm 34 may proximate to or contact with the protrusive portion 24 of the metal door 2.

Figure 4:
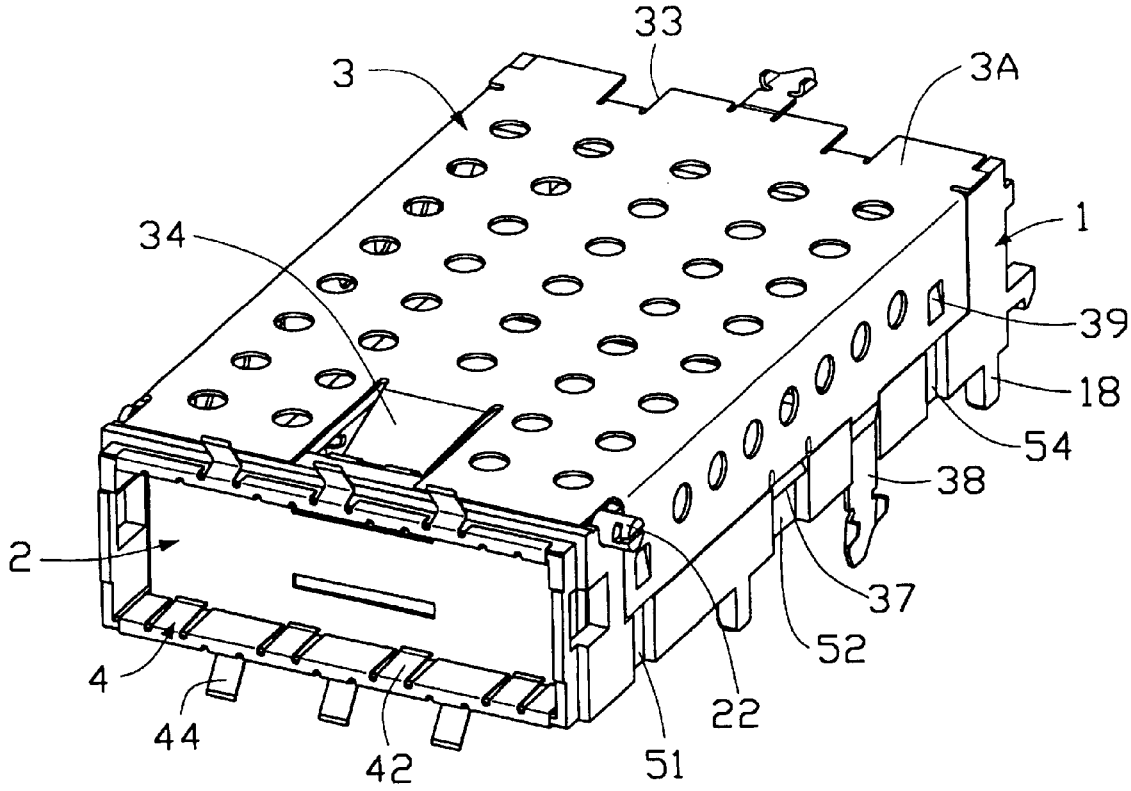
FIG. 4 is a fully assembled view of FIG. 1.

Also referring to FIG.4, the ground plates 4 are configured to the closure 17 by engaging the curved side wall 41 and the resilient latches 42 with upper and lower beams (not labeled) of the closure 17 while leaving the grounding tabs 44 extending out of the closure 17 for making electrical contact with a metal enclose, such as a server enclose (not shown) which accommodates the bracket therein when the bracket is used with the metal enclose.

Figure 5:
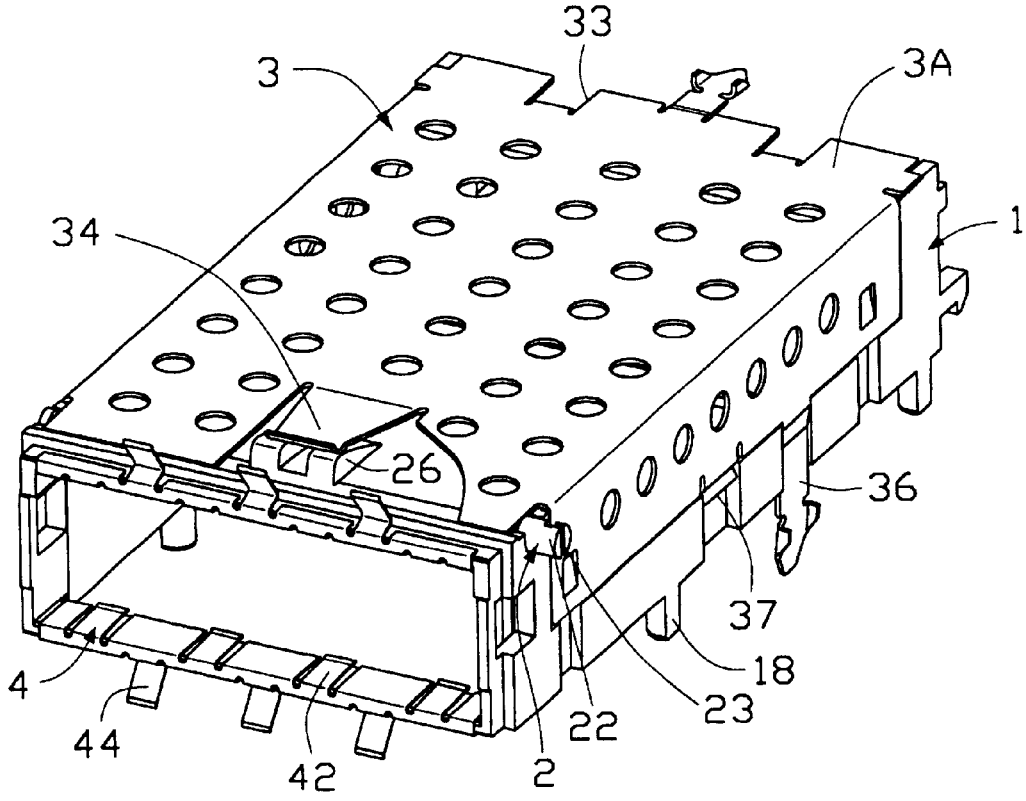
FIG. 5 is a view similar to FIG. 4, except that the metal door has been opened after insertion of an external electric device.

Also referring to FIG. 5, when an external electric device such as a transceiver module (not shown) is inserted into the bracket from the metal door 2, it will drive the plate portion 25 together with the shaft 21 to rotate for 90 degrees thus driving the metal door from a normally closed position to an opened position, meanwhile the spring arm 34 will be deformed by the protrusive portion 24 of the shaft 21 thereby storing a tension for recovering the metal door 2 back to its closed position upon withdrawal of the external transceiver module. The indication mark 23 of the stop 22 indicates whether the door 2 is opened or not from a side view.

While the present invention has been described with reference to a specific embodiment, the description is illustrative of the invention and is not to be construed as limiting the invention. Therefore, those can make various modifications to the present invention to the preferred embodiment skilled in the art without departing from the true spirit ad scope of the invention as defined by the appended claims,

What is claimed is:

1. A bracket for receiving an external electrical device, the bracket comprising:

a frame;

a door rotatably positioned on the frame by a shaft traversing the door, the shaft having a driving portion formed thereon; and a metal shielding fixedly attached to the frame and comprising a spring portion registered with the driving portion of the door;

wherein the driving portion of the door deforms the spring portion of the metal shielding when the door is rotated due to insertion of the external electric device into the bracket;

wherein the driving portion is a protrusion extending from the shaft;

wherein the spring portion is a spring arm extending from the metal shielding;

wherein the frame comprises a rectangular closure and two side walls extending in parallel from opposite sides of the rectangular closure;

wherein a pair of position recesses is defined in the side walls of the frame for positioning the door;

wherein each of the positioning recesses is a cutout defined in a top surface of side wall;

wherein the shaft has two stops formed at two ends thereof for retaining the shaft in position with respect to the positioning recesses;

wherein the stop has an indication mark for indicating from a side view whether the door is opened or not;

wherein the driving portion comprises two spaced-apart cambered tabs;

wherein the frame is made of metal material;

further comprising a pair of ground plates fixed to opposite sides of the closure;

wherein the ground plate has a curved side wall and a plurality of resilient latches and grounding tabs alternately extending from the curved side wall.

* * * * *